US005197645A

United States Patent [19]

Nordlof

[11] Patent Number: 5,197,645

[45] Date of Patent: * Mar. 30, 1993

[54] ROLL TYPE STOCK FEED APPARATUS WITH PNEUMATICALLY ACTUATED ROLL RELEASE

[76] Inventor: Richard D. Nordlof, 3312 Crest Rd., Rockford, Ill. 61107

[ * ] Notice: The portion of the term of this patent subsequent to Jul. 23, 2008 has been disclaimed.

[21] Appl. No.: 681,985

[22] Filed: Apr. 8, 1991

Related U.S. Application Data

[63] Continuation-in-part of Ser. No. 404,118, Sep. 7, 1989, Pat. No. 5,033,342.

[51] Int. Cl.[5] ..... B65H 20/00

[52] U.S. Cl. ..... 226/154; 226/160

[58] Field of Search ..... 226/148, 152, 154, 156, 226/160, 176, 180, 181, 177

[56] References Cited

U.S. PATENT DOCUMENTS

| | | | |
|---|---|---|---|
| 3,483,782 | 12/1969 | Eyberger | 226/154 X |
| 3,674,194 | 7/1972 | Moesser | 226/190 X |
| 3,707,255 | 12/1972 | Ridgway et al. | 226/136 |
| 3,782,618 | 1/1974 | Voorhees | 226/155 |
| 4,029,251 | 6/1977 | Johnson | 226/154 |
| 4,043,494 | 8/1977 | Bichford et al. | 226/154 X |
| 4,048,831 | 9/1977 | Fabian et al. | 226/180 X |
| 4,078,416 | 3/1978 | Voorhees et al. | 226/181 X |
| 4,119,256 | 10/1978 | Vogtmann | 226/177 |
| 4,470,592 | 9/1984 | Takahaghi | 226/177 X |
| 4,788,908 | 12/1988 | Segiyama et al. | 226/154 X |
| 4,852,787 | 8/1989 | Radtke et al. | 226/152 X |
| 5,033,342 | 7/1991 | Nordlof | 83/73 |
| 5,072,872 | 12/1991 | Casset et al. | 226/176 |

*Primary Examiner*—John M. Jillions
*Assistant Examiner*—Paul T. Bowen
*Attorney, Agent, or Firm*—Vernon J. Pillote

[57] ABSTRACT

A roll type stock feed apparatus for a power press. The stock feed apparatus has a pneumatic system for actuating the feed rolls between stock feed and stock release positions. Pressurized air in a substantially constant pressure is applied to one side of a pneumatic actuator to press the feed rolls into feeding engagement with strip stock between the rolls, and pressurized air is selectively applied and exhausted from the other side of the actuator piston to respectively release and apply feeding pressure to the stock feed rolls. An adjustable stop is provided to limit movement of the actuator pistons in a stock release direction.

13 Claims, 2 Drawing Sheets

ROLL TYPE STOCK FEED APPARATUS WITH PNEUMATICALLY ACTUATED ROLL RELEASE

CROSS-REFERENCE TO RELATED APPLICATIONS

This application is a continuation-in-part of the application of Richard D. Nordlof for "Roll Type Stock Feed Apparatus For A Punch Press", Ser. No. 07/404,118, filed Sep. 7, 1989 now U.S. Pat. No. 5,033,342, issued Jul. 23, 1991.

BACKGROUND OF THE INVENTION

The present invention relates to a roll type stock feed apparatus for a punch press or the like. Some punch and die sets, for example progressive type punch and dies, punch a pilot hole or holes in the stock at one station and have a pilot pin or pins adapted to enter the pilot hole at a subsequent die station, for final positioning of the stock during each press cycle. Various roll type stock feed apparatus have heretofore been made which are operative during each punch cycle to drive the feed rolls and advance the stock in a selected increment; to release the feed rolls from the stock prior to entrance of the pilot pins into the pilot holes and to reapply the feed rolls prior to initiating a subsequent drive cycle of the feed rolls. U.S. Pat. No. 3,707,255 discloses a roll type stock feed apparatus having an electromagnetic actuator for cyclically releasing feed pressure on the feed rolls; U.S. Pat. Nos. 3,782,618 and 4,078,416 disclose roll type feed apparatus having hydraulic actuators for releasing and applying feed pressure on the feed rolls, and U.S. Pat. No. 4,788,908 discloses an air actuated feed roll release system. In general, the response time required to move the feed rolls into gripping engagement with the stock and the response time required to move the feed rolls out of gripping engagement with the stock does not change with the speed of the press and these response times are a significant factor in limiting the maximum speed at which the press can be operated.

SUMMARY OF THE INVENTION

An important object of this invention is to provide a roll type stock feed apparatus having an improved pneumatic system for applying and releasing feed pressure on the feed rolls, and which reduces the response time required for applying and releasing the feed rolls during each cycle.

Another object of this invention is to provide a roll type stock feed apparatus having pneumatic system for applying and releasing feed pressure on the feed rolls in accordance with the foregoing object, and which is reduces the volume of air required to apply and release feed pressure on the feed rolls.

Accordingly, the present invention provides a roll type stock feed apparatus having an improved pneumatic actuator means for moving the feed roll means into and out of feeding engagement with the strip stock between the rolls. The pneumatic actuator means includes piston means having first and second faces at opposite sides, piston rod means extending from the second face and engaging a movable feed roll means, and a first actuator chamber means at the first face of the piston means and the second actuator means at the second face of the piston means. A first air pressure supply means supplies pressurized air to the first acctuator chamber means at a substantially constant first pressure sufficient to move the piston means in a first direction and press the movable roll means into feeding engagement with the strip stock between the feed rolls, when the second actuator chamber is communicated with atmosphere. A second air pressure supply means includes valve means selectively operable to first and second conditions, for controling air pressure in the second actuator chamber. The second air pressure supply means in the first condition of the valve means supplies pressurized air at a second pressure sufficient for moving the piston means in a second direction against the first pressure in the first actuator chamber to a stock release position, and the valve means in the second condition shuts off supply of pressurized air to the second actuator chamber means and communicates the latter to atmosphere to rapidly exhaust air from the second actuator chamber means and allow the piston means to move in the first direction under the pressure in the first chamber and press the movable feed roll means into feeding engagement with the stock.

The movement of the piston required to release the stock will vary with the thickness of the stock and a selectively adjustable stop means is provided for engaging the piston to adjustably limit movement of the piston in a release direction. The stop means includes plunger means guidably mounted on the frame and engageable with the piston means and extending out of the first actuator able with the plunger.

In order to achieve more uniform movement of the movable feed roll while also minimizing the piston travel required to effect movement of the feed roll, the pneumatic actuator preferably includes two pistons each having a piston rod engaging to the movable roll at locations spaced apart in a direction lengthwise of the feed roll.

DETAILED DESCRIPTION

The roll type stock feed apparatus of the present invention is adapted to intermittently advance strips of stock on each operating cycle of a power press (not shown), and is arranged to release feed pressure on the feed rolls during a portion of each press cycle so that pilot pins on the press dies can enter into the pilot holes on the sheet material to position the same, and to reapply the pressure to the feed roll before the feed rolls are driven to advance a further length of stock.

Figure 2:
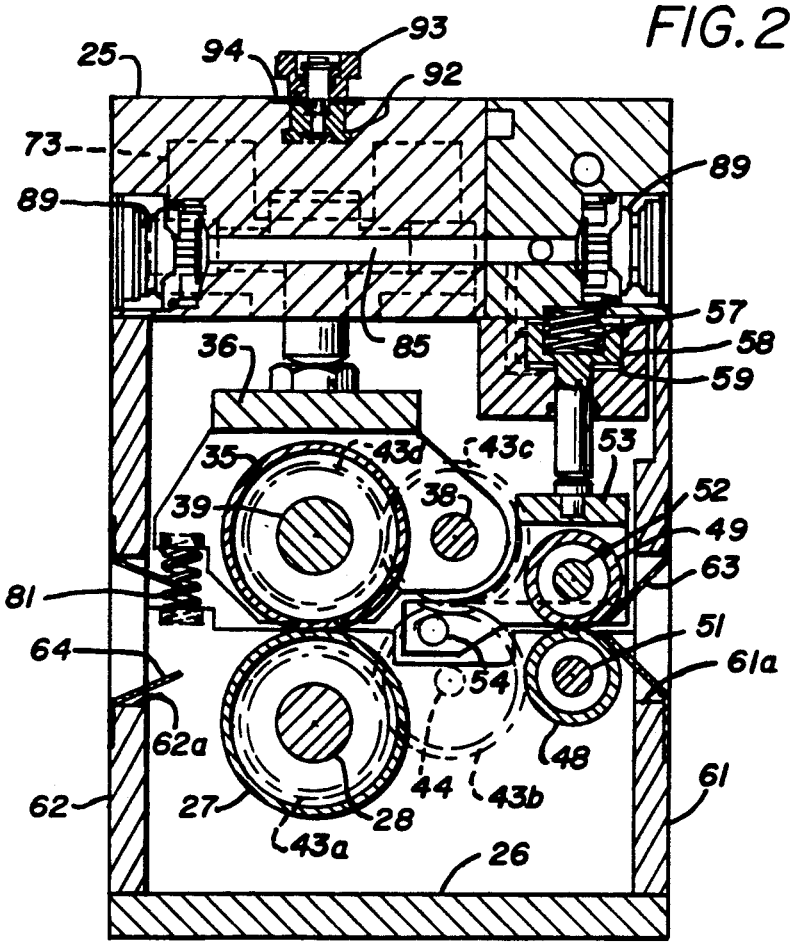
FIG. 2 is a longitudinal vertical sectional view of the stock feed apparatus taken on the plane 2—2 of FIG. 1.

The roll type stock feed apparatus has a rigid feed frame structure including upright frame members 23 and 24 that extend lengthwise of the stock feed path and which are rigidly interconnected by top plate 25 and a bottom plate 26. A lower feed roll 27 is rigidly affixed to a shaft 28 that is rotatably supported by bearings 29 on the frame members 23 and 24. A roll drive means such as a servo-motor 32 is rigidly mounted on the frame member 24 and has its output shaft 33 drivingly connected to the roller shaft 28. A upper feed roll 35 is mounted on a roll support yoke 36 for limited movement toward and away from the lower feed roll. The support yoke 36 includes end members that are rigidly interconnected by a cross member and the end members are swingably supported on a shaft 38 (FIG. 2) fixed to the frame members 23 and 24. The upper feed roll 35 is fixed to a shaft 39 that is rotatably supported by bearings 41 in the yoke end members. In the preferred embodiment illustrated, the upper feed roll is drivingly connected to the lower feed roll for rotation at the same speed but in a relatively opposite direction. As shown in FIG. 2, a gear 43*a* on the drive roll shaft 28 meshes with an idler gear 43*b* on a stub shaft 44 and idler gear 43*b* meshes with an idler gear 43*c* rotatably supported on the end of shaft 38 and drives a gear 43*d* on the upper feed roll shaft 39. Gears 43*a*–43*d* have the same pitch diameter and drive the upper feed roll at the same speed but in an opposite direction to the lower feed roll, while accommodating limited shifting movement of the upper feed roll in a direction crosswise of the stock feed relative to the lower feed roll. An end cover plate 45 is affixed to the frame member 23 to enclose the gears 43*a*–43*d*.

Anti-backup rolls 48 and 49 are preferably provided and, as best shown in FIG. 2, one of the backup rolls 48 is mounted on a cross shaft 51 that is rotatably supported on the frame members 23 and 24, and a one-way clutch (not shown) is provided to allow rotation of the roll 48 in the direction of forward stock feed while preventing reverse rotation. The upper roll 49 is fixed to a shaft 52 rotatably supported in a yoke 53. Yoke 53 is mounted for limited pivotal movement on the frame members 23 and 24 by pintles 54 to allow shifting of the roll 49 toward and away from the roll 48. As shown in FIG. 2, the roll 49 is yieldably biased toward the lower roll 48 by a spring 57, and a means such as an actuator piston 58 disposed in a cylinder 59 affixed to the top plate of the frame, is provided for selectively shifting the roll 49 away from the roll 48, to facilitate threading the stock through the feed apparatus. As shown in FIG. 2, cover plates 61 and 62 are fixed to the frame members 23 and 24 to enclose the feed roll assembly and have openings 61*a* and 62*a* to allow passage of stock therethrough. Inlet and outlet stock feed guides 63 and 64 are provided to facilitate guiding of the stock into and out of the nip between the rollers.

As previously described, with punch and die assemblies utilizing pilot pins for final positioning of the stock during each press cycle, it is necessary to release the feed rolls from the stock prior to entrance of the pilot pins into the pilot hole and to reapply feed pressure to the rolls prior to initiating drive of the feed rolls. In general, the time required to move the feed rolls into feeding engagement with the stock and the time required to shift the feed rolls out of feeding engagement with the stock does not change with the speed of the press and these response times are a significant factor in limiting the maximum speed at which the press can be operated.

Figure 1:
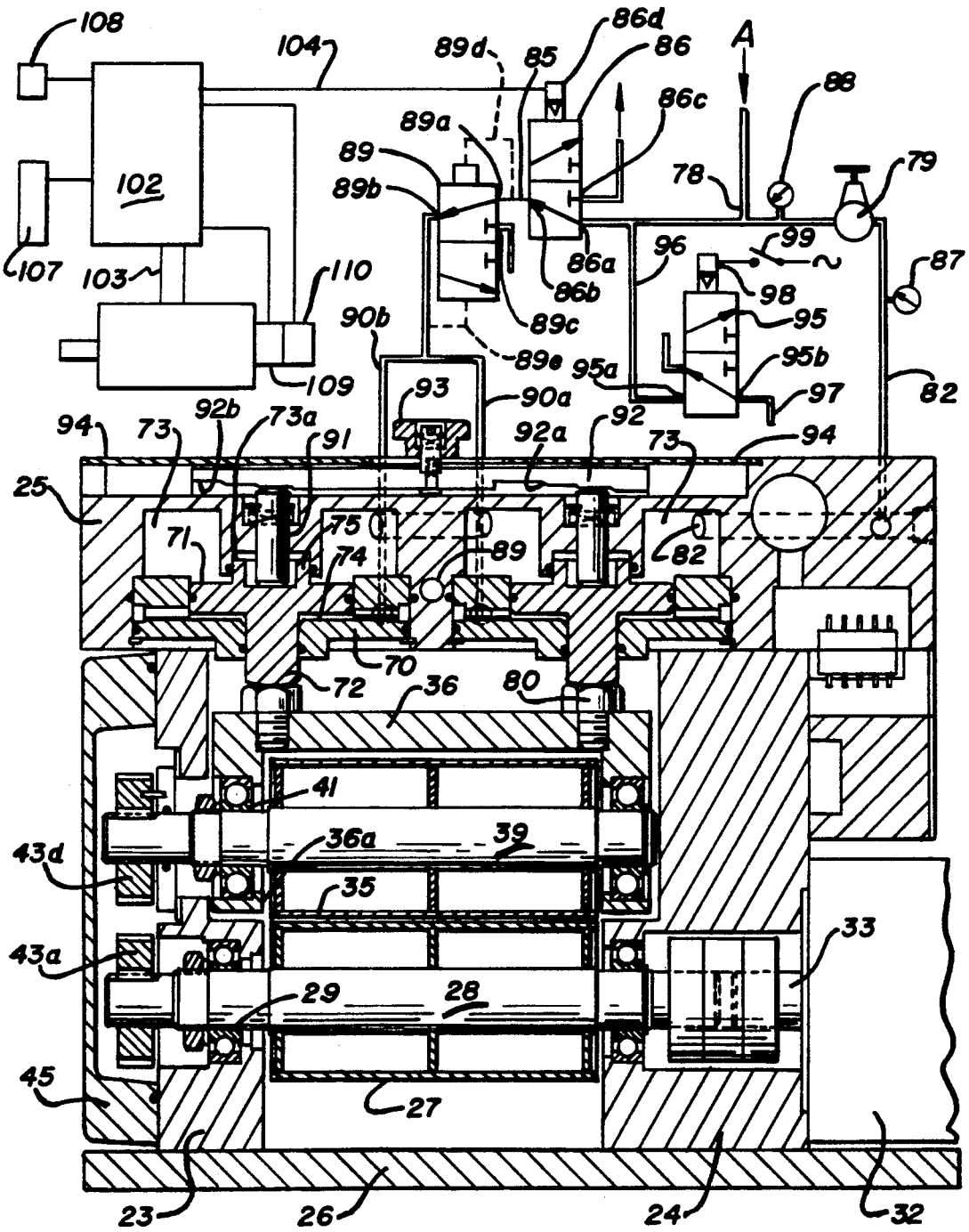
FIG. 1 is a transverse vertical sectional view through the stock feed apparatus, with the electrical and pneumatic controls illustrated schematically.

An improved pneumatic system is provided for applying and releasing feed pressure on the feed rolls, which reduces the time intervals required for applying and releasing the feed rolls during each operating cycle of the press. As best shown in FIG. 1, at least one and preferably two double acting feed roll actuator pistons 71 are provided for applying and releasing feed pressure from the upper feed roll. The pistons 71 are each slidably mounted in a head 70 fixed to the top plate 25 and the pistons each have a rod 72 that extends downwardly through the head. The top plate 25 defines an upper actuator chamber 73 at the upper side of each piston and the heads 72 define a lower actuator chamber 74 at the lower side of each piston. Each piston is provided with an upper boss 75 having a sliding seal in a counterbore 73*a* in the upper plate 25. The boss 75 has a cross section at least as large and preferably larger than the cross section of the piston rod 72 so that the area of the lower piston face between the piston rod 72 and the outer periphery of the piston that is exposed to the pressure in the chamber 74 at the underside of actuator piston is at least as large and preferably larger than the area of the upper piston face between the boss 75 and the outer periphery of the piston that is exposed to the pressure in the upper chamber 73. With this arrangement, the same plant air supply can be used to supply pressurized air through regulator 79 at a pressure somewhat below plant air supply pressure to the upper actuator chambers and to also supply pressurized air at a higher pressure at the lower actuator chamber. The piston rods 72 extend downwardly from the heads 70 and engage wear pads 80 on the movable roll support 36 for the upper roll, to apply and release feeding pressure on the upper roll. As shown in FIG. 2, the movable roll support 36 for the upper roll is yieldably urged upwardly by springs 81 which are adapted to raise the upper feed roll when the pistons are actuated to release feed pressure.

Figure 3:
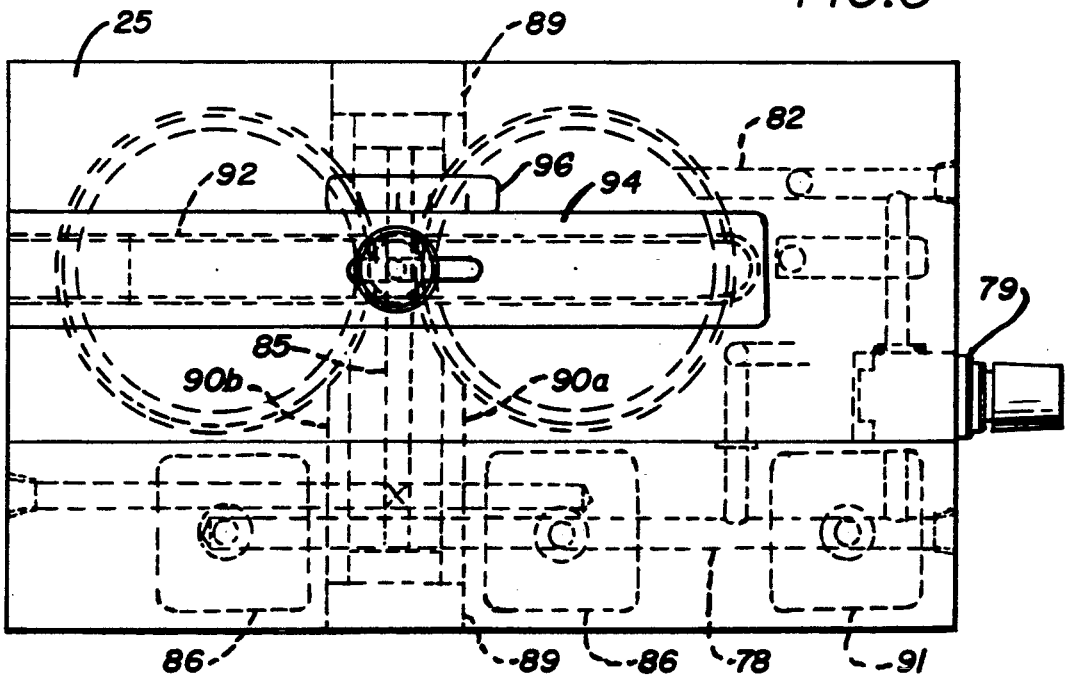
FIG. 3 is a top plan view of the stock feed apparatus.

In accordance with the present invention, means are provided for supplying pressurized air to the upper actuator chambers at a substantially constant first pressure sufficient to move the feed roll means downwardly into feeding relation with strip stock when the second actuator chamber is communicated to atmosphere, and means are provided for controlling the air pressure in the lower actuator chamber to apply and release feed pressure on the upper feed roll. As schematically illustrated in FIG. 1, air from a source of pressurized air such as the plant air supply designated A, is supplied through a passage 78 and a pressure regulator 79 to a passage 82 communicating with the upper actuator chambers 73. The pressurized air supplied to the upper actuator chambers 73 acts on the upper faces of the pistons 71 to yieldably press the upper feed roll downwardly with a substantially constant pressure determined by regulator 79. The regulator is preferably of the adjustable type to enable adjustment of the feed roll pressure to accommodate different types of stock and stock feed conditions and a pressure gauge 87 is provided in line 83 to facilitate adjustment of the regulated air pressure. The volume of the upper chamber 73 is preferably made very large as compared to the displacement of the pistons 71, as shown in FIG. 1, to minimize fluctuations in air pressure in the actuator chambers 73 during rapid movement of the pistons. As schematically illustrated in FIG. 1, air under pressure from the plant air supply A is also supplied from passage 78 to the pressure inlet 86*a* of a normally open three-way valve 86 having an electro-responsive actuator 86*d* and a pressure guage 88 is provided to indicate the pressure of the plant air supply. The controlled outlet 86*b* of the three-way valve is connected through a passage 85 to the pressure inlet 89*a* of a quick exhaust valve 89, and the controlled outlet 89*b* of the quick exhaust valve is connected through passages 90 to the lower actuator chambers 74. The quick exhaust valve 89 is of conventional construction and, when the inlet port 89*a* is pressurized, pressure is applied as indicated by the pilot passage 89*d* to shift the quick exhaust valve to a position communicating the pressure port 89*a* with the controlled outlet port 89b as shown in FIG. 1. When valve 86 is moved to its second condition it blocks in the pressure passage 86a and communicates the controlled outlet passage 86b with an exhaust passage 86c. The pressure at the controlled outlet port 86b of valve 86 and hence the pressure at the port 89a of the quick exhaust valve 89, is then reduced to atmospheric and pressure from passage 90, applied as indicated by pilot passage 89e, shifts the quick exhaust valve to a position blocking the pressure port 89a and communicating the controlled port 89b with the exhaust port 89c. As is conventional, the quick exhaust valve has relatively large exhaust passages and ports for rapid flow during exhaust. With the above-described arrangement, when electro-responsive actuator 86d is de-energized, the control valve 86 moves to its normal open position and air at supply line pressure is supplied from passage 78, through quick exhaust valve 89 and passage 90 to the lower actuator chambers 74 to rapidly pressurize the lower chambers and move the pistons 71 and upper feed roll to a raised position. When the electro-responsive actuator 86d is energized, the control valve 86 is moved to its closed position and connects the controlled outlet port 86b with the exhaust outlet 86c. The quick exhaust valve 89 is then shifted to a position connecting the controlled outlet port 89b with the exhaust outlet 89c, to rapidly exhaust pressure from the lower actuator chambers 74, so that pressure at the upper side of the piston rapidly moves the upper feed roll 35 down into feeding engagement with the stock. As schematically illustrated in FIG. 1, a single control valve 86 and a single quick exhaust valve 89 are illustrated for controlling air supply to the lower actuator chamber 74 of both pistons. It is preferred, however, to use two control valves 86 as indicatead at 86 in FIG. 3 and two quick exhaust valves 89 as shown in FIG. 2. The control valves are connected in parallel with each other between passage 78 and the common controlled outlet passage 85, and the quick exhaust valves 89 are similarly connected parallel with each other between passage 85 and passages 90a and 90b that communicate with the lower actuator chambers 74.

The stock feed apparatus is adapted to feed strip stock of different thicknesses and, in accordance with another aspect of the present invention, a selectively adjustable stop means is provided for adjustably limiting movement of the feed pressure applying pistons in a release direction, to reduce the return travel of the pistons to the minimum necessary for releasing the feed roll. Reducing the pistons stroke reduces the response time required to thereafter move the feed roll back into feeding engagement with the strip stock and also reduces the air consumption. As shown in FIG. 1, the stop means includes plungers 91 guidably mounted in the upper plate 25 for movement along a path axially of the pistons. The plungers have an inner end engageable with the associated piston inwardly of the boss 75 and an outer end disposed externally of the upper actuator chamber. A stop plate 92 is mounted on the frame for movement in a direction crosswise of the upper ends of the plungers 91. The stop plate 92 has first and second stepped stop faces 92a and 92b at its underside and the stop plate is movable along a path crosswise of the upper ends of the plungers to position corresponding steps in the stepped faces above the plungers 91, to simultaneously adjust the release position of both pistons. A means such as a thumb screw 93 that extends through a slot in a cover plate 94, is provided for locking the stop plate in different adjusted positions and an indicia plate 96 having indicia corresponding to different stock thickness, is provided on the top plate 25, to indicate the setting of the stop plate.

As also schematically shown in FIG. 1, a normally closed actuator valve 95 is provided for actuating the piston actuator 58 of the anti-backup roll 49 to a release position. As shown, the pressure inlet port 95a is connected through a passage 96 to the pressure supply A and the controlled outlet port 95b is connected through a passage 97 to the actuator chamber 59 (FIG. 2) at the underside of the piston 58. Valve 95 is normally closed to communicate the controlled outlet port 95b with exhaust outlet port 95c so that the upper anti-backup roll is normally pressed into engagement with the stock by the spring 57. Valve 95 has an electro-responsive actuator 98 which can be selectively energized under the control of a switch 99 to move the valve to an open position in which it supplies pressurized air to the actuator chamber 59 to raise the anti-backup roll.

The feed roll drive motor 32 and the control valve 86 are operated in timed relation with the power press to press the feed roll into feeding engagement with the stock before the roll drive means is operated to advance the length of stock, and to release pressure on the feed roll means before the pilot pins enter on the pilot holes in the stock, and to thereafter reapply feed pressure to the feed rolls. As diagrammatically illustrated in FIG. 1, the programmable control 102 is connected through a buss 103 to the roll drive motor 32 and through conductors 104 to the electro-responsive operator 86d for control valve 86. Feed command signals from an operator interface 107 are supplied to the programmable controller and signals correlative with the press crank shaft position are supplied to the programmable controller as from a rotary resolver or encoder 108 driven from the press crank shaft. The roll drive motor 32 is preferably a servo- motor having a tachometer 109 and a motor shaft encoder 110 connected to the servo motor to provide feedback signals correlative with the speed and rotational position of the feed rolls. The operator interface is arranged to provide command signals representative of the desired stock feed length and the grip and release timing of the feed rolls.

The embodiments of the invention in which an exclusive property or privilege is claimed are defined as follows:

1. A roll type stock feed apparatus for intermittently advancing strip stock to a power press in timed relation with successive operating cycles of the press, the stock feed apparatus including rigid frame means; first feed roll means mounted on the frame means, second feed roll means mounted on a movable roll support means for movement toward and away from the first feed roll means, roll drive means drivingly connected to at least one of the feed roll means and actuatable to drive said one of the feed roll means to advance a preselected length of stock, means including pneumatic actuator means for moving said second feed roll means toward and away from the first feed roll means respectively into and out of feeding engagement with strip stock therebetween, said pneumatic actuator means including piston means having first and second piston faces at opposite sides and piston rod means extending from the second face and operatively engaging the movable roll support means, said pneumatic actuator means including means on the frame means defining a first actuator chamber means at the first face of the piston means and second actuator chamber means at the second face of the piston means, first air pressure supply means for supplying and maintaining pressurized air in said first actuator chamber means under a substantially constant first pressure sufficient to move the piston means in a first direction and press said second feed roll means toward the first feed roll means into feeding relation with strip stock between the first and second feed roll means when the second actuator chamber means is communicated to atmosphere, second air pressure supply means including valve means selectively operable to first and second conditions for controlling air pressure in the second actuator chamber means while said first air pressure supply means maintains the first actuator chamber means under said substantially constant first pressure, said second air pressure supply means in the first condition of the valve means supplying pressurized air at a second pressure sufficient for moving the piston means in a second direction against the first pressure in the first actuator chamber means to a stock release position, said valve means in the second condition shutting off pressurized air to the second actuator chamber means and communicating the latter to atmosphere to rapidly exhaust air from the second actuator chamber means and allow the piston means to move in the first direction under the substantially constant first pressure in the first actuator chamber means, and means including press cycle sensing means for actuating said roll drive means to advance a preselected length of stock and for operating said valve means between said first and second conditions in timed relation with the actuating of said feed roll drive means during each press operating cycle.

2. A roll type stock feed apparatus according to claim 1 wherein said valve means includes electro-responsive three-way valve means connected by passage means to said second actuator chamber means, and quick exhaust valve means in said passage means.

3. A roll type stock feed apparatus according to claim 1 wherein said piston means includes two pistons each having a piston rod engaging the movable roll support means at locations spaced apart in a direction lengthwise of said second feed roll means.

4. A roll type stock feed apparatus according to claim 1 including selectively adjustable stop means engageable with the piston means for stopping movement of the piston means in said second direction at different presetable positions.

5. A roll type stock feed apparatus according to claim 4 wherein the stop means includes plunger means guidably mounted on the frame means and engageable with the piston means for stopping movement of the piston means in said second direction, and a stop mounted on the frame means and engageable with the plunger means for adjustably stopping movement of the plunger means.

6. A roll type stock feed apparatus according to claim 4 wherein said stop means includes a stop plate slidably mounted on the frame means for movement along a path crosswise of the direction of movement of the piston means.

7. A roll type stock feed apparatus according to claim 1 wherein the area of the first face of the piston means exposed to pressure in the first actuator chamber means is less than the area of the second face of the piston means exposed to pressure in the second actuator means.

8. A roll type stock feed apparatus for intermittently advancing strip stock to a power press in timed relation with successive operating cycles of the press, the stock feed apparatus including rigid frame means; first feed roll means mounted on the frame means, second feed roll means mounted on a movable roll support means for movement toward and away from the first feed roll means, roll drive means drivingly connected to at least one of the feed roll means and actuatable to drive said one of said feed roll means to advance a preselected length of stock, means including pneumatic actuator means for moving said second feed roll means toward and away from the first feed roll means respectively into and out of feeding engagement with strip stock therebetween, said pneumatic actuator means including two pistons each having first and second piston faces at opposite sides and a piston rod means extending from the second face and operatively engaging the movable roll support means at locations spaced apart in a direction lengthwise of the second feed roll means, said pneumatic actuator means including means on the frame means defining a first actuator chamber means at the first face of each of the pistons and second actuator chamber means at the second face of each of the pistons, first air pressure supply means for supplying and maintaining pressurized air in said first actuator chamber means under a substantially constant first pressure sufficient to move the pistons in a first direction and press said second feed roll means toward the first feed roll means into feeding relation with strip stock between the first and second feed roll means when the second actuator chamber means is communicated to atmosphere, second air pressure supply means including valve means selectively operable to first and second conditions for controlling air pressure in the second actuator chamber means while said first air pressure supply means maintains the first actuator chamber means under said substantially constant first pressure, said second air pressure supply means in the first condition of the valve means supplying pressurized air at a second pressure sufficient for moving the piston means in a second direction against the first pressure in the first actuator chamber means to a stock release position, said valve means in the second condition shutting off pressurized air to the second actuator chamber means and communicating the latter to atmosphere to rapidly exhaust air from the second actuator chamber means and allow the piston means to move in the first direction under the substantially constant pressure in the first actuator chamber means, and means including press cycle sensing means for actuating said roll drive means to advance a preselected length of stock and for operating said valve means between said first and second conditions in timed relation with the actuation of said feed roll drive means during press operating cycle.

9. A roll type stock feed apparatus according to claim 8 wherein said valve means included electro-responsive three-way valve means connected by passage means to said second actuator chamber means, and quick exhaust valve means in said passage means.

10. A roll type stock feed apparatus according to claim 8 including selectively adjustable stop means engageable with the pistons for stopping movement of both pistons in said second direction at different presetable positions.

11. A roll type stock feed apparatus according to claim 10 wherein the stop means includes two plungers guidably mounted on the frame means and each engageable with one of the pistons for stopping movement of the associated piston in said second direction and a stop plate mounted on the frame means and engageable with the plungers for stopping movement of the plungers.

12. A roll type stock feed apparatus according to claim 10 wherein said stop means includes a stop plate slidably mounted on the frame means for movement along a path crosswise of the direction of movement of the pistons.

13. A roll type stock feed apparatus according to claim 8 wherein the area of the first face of the piston means exposed to pressure in the first actuator chamber means is less than the area of the second face of the piston means exposed to pressure in the second actuator means.

* * * * *